US007675397B2

(12) United States Patent
Kim et al.

(10) Patent No.: US 7,675,397 B2
(45) Date of Patent: Mar. 9, 2010

(54) TRANSFORMER

(75) Inventors: Ki Joong Kim, Jeollabuk-Do (KR); Shinichi Iizuka, Gyunggi-Do (KR); Sang Hee Kim, Seoul (KR); Hyo Keun Bae, Gyunggi-Do (KR); Youn Suk Kim, Daejeon (KR)

(73) Assignee: Samsung Electro-Mechanics Co., Ltd., Suwon, Gyunggi-Do (KR)

( * ) Notice: Subject to any disclaimer, the term of this patent is extended or adjusted under 35 U.S.C. 154(b) by 0 days.

(21) Appl. No.: 12/100,325

(22) Filed: Apr. 9, 2008

(65) Prior Publication Data

US 2009/0085705 A1 Apr. 2, 2009

(30) Foreign Application Priority Data

Sep. 27, 2007 (KR) ..... 10-2007-0097580

(51) Int. Cl.
*H01F 5/00* (2006.01)
*H01F 27/29* (2006.01)
*H01F 27/28* (2006.01)

(52) U.S. Cl. ..... 336/200; 336/192; 336/223; 336/232

(58) Field of Classification Search ..... None
See application file for complete search history.

(56) References Cited

U.S. PATENT DOCUMENTS 5,973,568 A * 10/1999 Shapiro et al. ..... 330/295
6,577,219 B2 * 6/2003 Visser ..... 336/200
6,737,948 B2 * 5/2004 Aoki et al. ..... 336/200
6,980,074 B1 * 12/2005 Jitaru ..... 336/200
7,110,266 B1 * 9/2006 Porter et al. ..... 363/21.01
7,154,349 B2 * 12/2006 Cabanillas ..... 331/117 R
7,305,223 B2 * 12/2007 Liu et al. ..... 455/333
7,439,841 B2 * 10/2008 Kim ..... 336/200
2007/0090913 A1 4/2007 Kim
2008/0042792 A1 * 2/2008 Chiu ..... 336/182

FOREIGN PATENT DOCUMENTS

KR 2002-0059326 A 7/2002
KR 2007-0044899 A 5/2007
WO WO 01/03279 A1 1/2001

* cited by examiner

*Primary Examiner*—Anh T Mai
*Assistant Examiner*—Mangtin Lian
(74) *Attorney, Agent, or Firm*—Lowe Hauptman Ham & Berner

(57) ABSTRACT

A transformer includes: a multilayer board; one or more input conductive lines formed on the multilayer board, whose both ends connected to input terminals of a positive signal and a negative signal, respectively; one output conductive line formed adjacent to the one or more input conductive lines to form an electromagnetic coupling with the one or more input conductive lines, whose one end is connected to an output terminal and another end is connected to a ground; a power supply pad formed in an area of the one or more input conductive lines; and a harmonics remover formed between the one end and the another end of the output conductive line to remove harmonics components of a signal outputted from the output conductive line.

14 Claims, 7 Drawing Sheets

TRANSFORMER

CROSS-REFERENCE TO RELATED APPLICATIONS

This application claims the priority of Korean Patent Application No. 2007-0097580 filed on Sep. 27, 2007, in the Korean Intellectual Property Office, the disclosure of which is incorporated herein by reference.

BACKGROUND OF THE INVENTION

1. Field of the Invention

The present invention relates to a transformer, and more particularly, to a transformer having an integrated passive device (IPD) used in a complementary metal-oxide semiconductor (CMOS) power amplifier.

2. Description of the Related Art

In general, at a transmitting terminal of a mobile communication terminal such as a mobile phone, a power amplifier is used to amplify power of a transmission signal. The power amplifier should amplify the transmission signal by appropriate power. As methods of controlling output power of a power amplifier, there are a close loop method in which a part of an output signal is detected via a transformer at an output terminal of the power amplifier and the signal is converted into a direct current (DC) by using a Schottky diode and compared with a reference voltage using a comparator and an open loop method of sensing a voltage or a current applied to the power amplifier and controlling power.

The closed loop method, which is generally used, has an advantage of precisely controlling power and a disadvantage of decreasing efficiency of the amplifier due to complexity of embodying a circuit and a loss caused by a coupler. The open loop method, which has a simple circuit structure and is generally used now, is incapable of precisely controlling power.

Recently, as elements used in the closed loop method are integrated as an integrated circuit (IC), it is simple to embody a circuit. Also, since performance of a control chip is improved, a coupling value of a directional coupler is greatly decreased, thereby greatly reducing a loss due to the directional coupler. Particularly, to a global system for mobile communication (GSM) in which a ramping profile is important, the close loop method capable of precisely controlling power is applied.

Researches to embody an effective transformer controlling an output of a power amplifier have been continuously performed. However, there are problems in which harmonics components occur in an output signal and the size of coupling varies with a location of a power supply pad when embodying a transformer.

SUMMARY OF THE INVENTION

An aspect of the present invention provides a transformer having a structure including a harmonics remover and a structure including a power supply pad capable of reducing an effect of coupling.

According to an aspect of the present invention, there is provided a transformer including: a multilayer board; one or more input conductive lines formed on the multilayer board, whose both ends connected to input terminals of a positive signal and a negative signal, respectively; one output conductive line formed adjacent to the one or more input conductive lines to form an electromagnetic coupling with the one or more input conductive lines, whose one end is connected to an output terminal and another end is connected to a ground; a power supply pad formed in an area of the one or more input conductive lines; and a harmonics remover formed between the one end and the another end of the output conductive line to remove harmonics components of a signal outputted from the output conductive line, wherein a part of the one or more input conductive lines is formed on a top surface of the multilayer board and rest of the one or more input conductive lines is formed on a different layer from the top surface of the multilayer board, which are connected to each other via a via hole, and a portion of the output conductive line is formed on the top surface of the multilayer board and another portion of the output conductive line is formed on the different layer from the top surface of the multilayer board, which are connected to each other via the via hole, not to be directly connected to the one or more input conductive lines.

The harmonics remover may include an inductor and a capacitor, serially connected to each other.

The one or more input conductive lines may include a capacitor element formed between the both ends of the one or more input conductive lines.

The one or more input conductive lines may include a first conductive wire, a second conductive wire, a third conductive wire, and a fourth conductive wire, forming one loop around the same area on the multilayer board, respectively.

The power supply pads formed on the first to fourth conductive wires, respectively, may be formed on the top surface of the multilayer board.

The output conductive line may include: a first loop formed between the first conductive wire and the second conductive wire; a second loop formed between the second conductive wire and the third conductive wire; and a third loop formed between the third conductive wire and the fourth conductive wire.

The harmonics remover may be formed in an inner area of the loops formed by the first to fourth conductive wires on the multilayer board.

The power supply pad may be formed in a location where an electrical radio frequency (RF) swing electric potential is 0 V in the one or more input conductive lines.

The power supply pad may be formed in such a way that a distance between the power supply pad and the output conductive line and a distance between the one or more input conductive lines where the power supply pad is formed and the output conductive line are uniform.

According to another aspect of the present invention, there is provided a transformer including: a multilayer board; one or more input conductive lines formed on the multilayer board, whose both ends are provided to input terminals of a positive signal and a negative signal; and an output conductive line formed adjacent to the one or more input conductive lines to form an electromagnetic coupling with the one or more input conductive lines, whose one end is connected to an output terminal and another end is connected to a ground; and a harmonics remover formed between the one end and the another end of the output conductive line to remove harmonics components in a signal outputted from the output conductive line, wherein a part of the one or more input conductive lines is formed on a top surface of the multilayer board and rest of the one or more input conductive lines is formed on a different layer from the top surface of the multilayer board, which are connected to each other via a via hole, and a portion of the output conductive line is formed on the top surface of the multilayer board and another portion of the output conductive line is formed on the different layer from the top surface of the multilayer board, which are connected to each other via the via hole, not to be directly connected to the one or more input conductive lines.

The harmonics remover may include an inductor and a capacitor, serially connected to each other.

The one or more input conductive lines may include a capacitor element formed between the both ends of the one or more input conductive lines.

The one or more input conductive lines may include a first conductive wire, a second conductive wire, a third conductive wire, and a fourth conductive wire, forming one loop around the same area on the multilayer board, respectively.

The output conductive line may include: a first loop formed between the first conductive wire and the second conductive wire; a second loop formed between the second conductive wire and the third conductive wire; and a third loop formed between the third conductive wire and the fourth conductive wire.

The harmonics remover may be formed in an inner area of the loops formed by the first to fourth conductive wires on the multilayer board.

According to another aspect of the present invention, there is provided a transformer including: a multilayer board; one or more input conductive lines formed on the multilayer board, whose both ends connected to input terminals of a positive signal and a negative signal, respectively; one output conductive line formed adjacent to the one or more input conductive lines to form an electromagnetic coupling with the one or more input conductive lines, whose one end is connected to an output terminal and another end is connected to a ground; and a power supply pad formed in an area of the one or more input conductive lines, wherein a part of the one or more input conductive lines is formed on a top surface of the multilayer board and rest of the one or more input conductive lines is formed on a different layer from the top surface of the multilayer board, which are connected to each other via a via hole, and a portion of the output conductive line is formed on the top surface of the multilayer board and another portion of the output conductive line is formed on the different layer from the top surface of the multilayer board, which are connected to each other via the via hole, not to be directly connected to the one or more input conductive lines.

The one or more input conductive lines may include a capacitor element formed between the both ends of the one or more input conductive lines.

The one or more input conductive lines may include a first conductive wire, a second conductive wire, a third conductive wire, and a fourth conductive wire, forming one loop around the same area on the multilayer board, respectively.

The power supply pads formed on the first to fourth conductive wires, respectively, may be formed on the top surface of the multilayer board.

The output conductive line may include: a first loop formed between the first conductive wire and the second conductive wire; a second loop formed between the second conductive wire and the third conductive wire; and a third loop formed between the third conductive wire and the fourth conductive wire.

The power supply pad may be formed in a location where an electrical RF swing electric potential is 0 V in the one or more input conductive lines.

The power supply pad may be formed in such a way that a distance between the power supply pad and the output conductive line and a distance between the one or more input conductive lines where the power supply pad is formed and the output conductive line are uniform.

According to the present invention, it is possible to obtain a transformer capable of reducing a loss of power when supplying the power, reducing an influence on a size of electromagnetic coupling while receiving the power, and reducing harmonics components of an output signal.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 1:
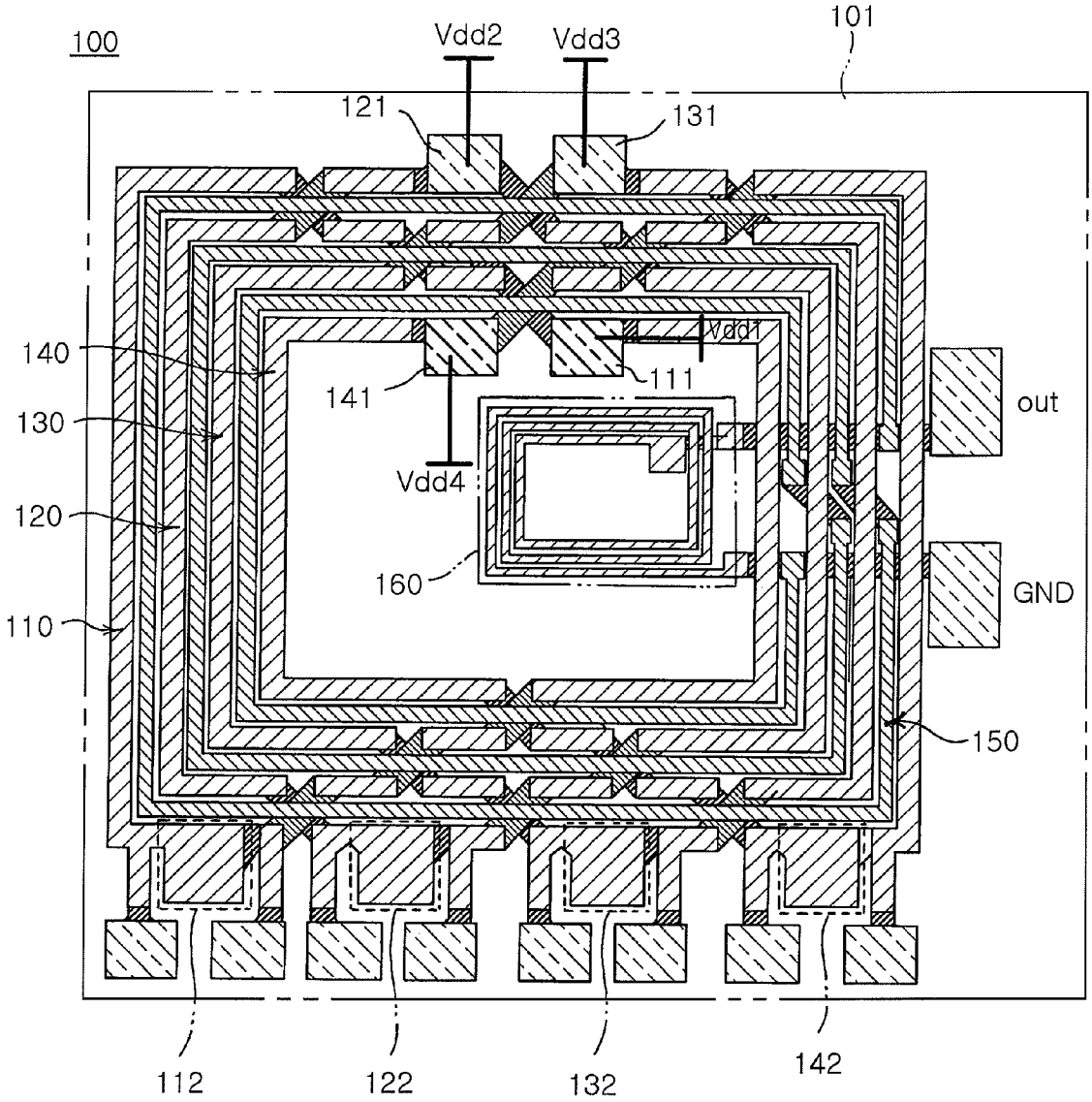
FIG. 1 is a diagram illustrating a structure of a transformer according to an embodiment of the present invention.

FIG. 1 is a diagram illustrating a structure of a transformer 100 according to an embodiment of the present invention.

Referring to FIG. 1, the transformer 100 includes a multilayer board 101, a plurality of input conductive lines 110, 120, 130, and 140 formed on the multilayer board 101, one output conductive line 150, power supply pads 111, 121, 131, and 141 forming apart of each of the plurality of input conductive lines 110, 120, 130, and 140, respectively, and a harmonics remover 160.

The multilayer board may be formed to have a plurality of layers.

In the present embodiment, the input conductive lines 110, 120, 130, 140 and the output conductive line 150 may be formed on a top surface of the multilayer board 101 and another layer thereof and may be connected to one another via a via hole, in such a way that the input conductive lines 110, 120, 130, 140 are not directly connected to the output conductive line 150. The multilayer board may be formed of a high frequency board.

Each of the input conductive lines 110, 120, 130, and 140 may have both ends provided to a positive input terminal and a negative input terminal, respectively. The both ends may be connected to a power amplifier connected to the transformer 100, respectively. The transformer 100 may be connected to the power amplifier formed of a complementary metal-oxide semiconductor used in a mobile communication terminal.

In the present embodiment, the four input conductive lines 110, 120, 130, and 140 may be formed to not to be connected to one another on the multilayer board 101. For this, a part of the respective input conductive lines 110, 120, 130, and 140 may be formed on the top surface of the multilayer board 101 and others may be formed on other layers different from the top surface of the multilayer board 101 to have a structure of being connected via the via hole. A detailed structure of the input conductive lines 110, 120, 130, and 140 formed on the multilayer board 101 will be described later with reference to FIG. 2A.

The four input conductive lines 110, 120, 130, and 140 may form a loop around the same area of the multilayer board 101, respectively.

Between the both ends of the each of the input conductive lines 110, 120, 130, and 140, capacitors 112, 122, 132, and 142 may be formed. The capacitors 112, 122, 132, and 142 may be embodied by forming conductive layers having a predetermined area on different layers of the multilayer board 101.

To form an electromagnetic coupling with the each of the input conductive lines 110, 120, 130, and 140, the output conductive line 150 may be formed adjacent to the input conductive lines 110, 120, 130, and 140. One end of the output conductive line 150 may be provided to an output terminal and another end thereof may be connected to a ground.

In the present embodiment, since the four input conductive lines 110, 120, 130, and 140 form the loop around the same area on the multilayer board 101, the output conductive line 150 may also form a loop around the same area on the multilayer board 101. Also, the loop may be formed between each of the respective input conductive lines 110, 120, 130, and 140 to form the electromagnetic coupling with the each of the input conductive lines 110, 120, 130, and 140.

The output conductive line 150 may have a structure in which a portion is formed on the top surface of the multilayer board 101 and another portion is formed on the another layer different from the top surface of the multilayer board 101, which are connected to one another via a via hole, not to directly connected to the respective input conductive lines 110, 120, 130, and 140.

The power supply pads 111, 121, 131, and 141 may be formed in one area of the respective input conductive lines 110, 120, 130, and 140.

The power supply pads 111, 121, 131, and 141 may be provided as terminals for supplying power to the respective input conductive lines 110, 120, 130, and 140, respectively. The power supply pads 111, 121, 131, and 141 may be located where an electrical radio frequency (RF) swing electric potential is 0 V in the respective input conductive lines 110, 120, 130, and 140. Since there is no direct current (DC) ground in a CMOS power amplifier, the CMOS power amplifier employs an alternative current (AC) ground. A location where the RF swing electric potential is 0 V indicates the AC ground.

The power supply pads 111, 121, 131, and 141 may be formed in such a way that a coupling value with the output conductive line 150 adjacent to the four input conductive lines 110, 120, 130, and 140 is uniform. Since the power supply pads 111, 121, 131, and 141 may have a greater width than a width of the input conductive lines 110, 120, 130, and 140, a distance to the output conductive line 150 may be different according to a location of each of the power supply pads 111, 121, 131, and 141. In the present embodiment, the power supply pads 111, 121, 131, and 141 may be located in an outermost area (121 and 131) and in an innermost area (111 and 141) of the input conductive lines 110, 120, 130, and 140 forming the loop, respectively, in such a way that a distance between the power supply pads 111, 121, 131, and 141 and the output conductive line 150 is identical to a distance between the input conductive lines 110, 120, 130, and 140 and the output conductive line 150.

Also, the power supply pads 111, 121, 131, and 141 may be formed in such a way that distances between the respective power supply pads 111, 121, 131, and 141 and the output conductive line 150 and distances between the input conductive lines 110, 120, 130, and 140 where the power supply pads 111, 121, 131, and 141 are formed, respectively, and the output conductive line 150 are definite.

Directly forming the power supply pads 111, 121, 131, and 141 on the input conductive lines 110, 120, 130, and 140, there is no need to form additional conductive lines to form the power supply pads 111, 121, 131, and 141. Accordingly, an undesired coupling that may be caused by another conductive line.

On the both ends of the output conductive line 150, the harmonics remover 160 may be formed.

Since an output signal of the transformer may be outputted including harmonics components, the harmonics remover 160 may be formed to remove the harmonics components.

In the present embodiment, the harmonics remover 160 may be formed in a center of the loops formed by the four input conductive lines 110, 120, 130, and 140 on the multilayer board 101.

The harmonics remover 160 may be formed in such a way that an inductor element and a capacitor element may be serially connected to each other. The inductor element may be connected via an external wire bonding, and harmonics in a desired band may be tuned by controlling a location of the wire bonding.

The harmonics components of the output signal outputted to the output terminal of the transformer may be removed by the inductor element and the capacitor element.

Figure 2A:
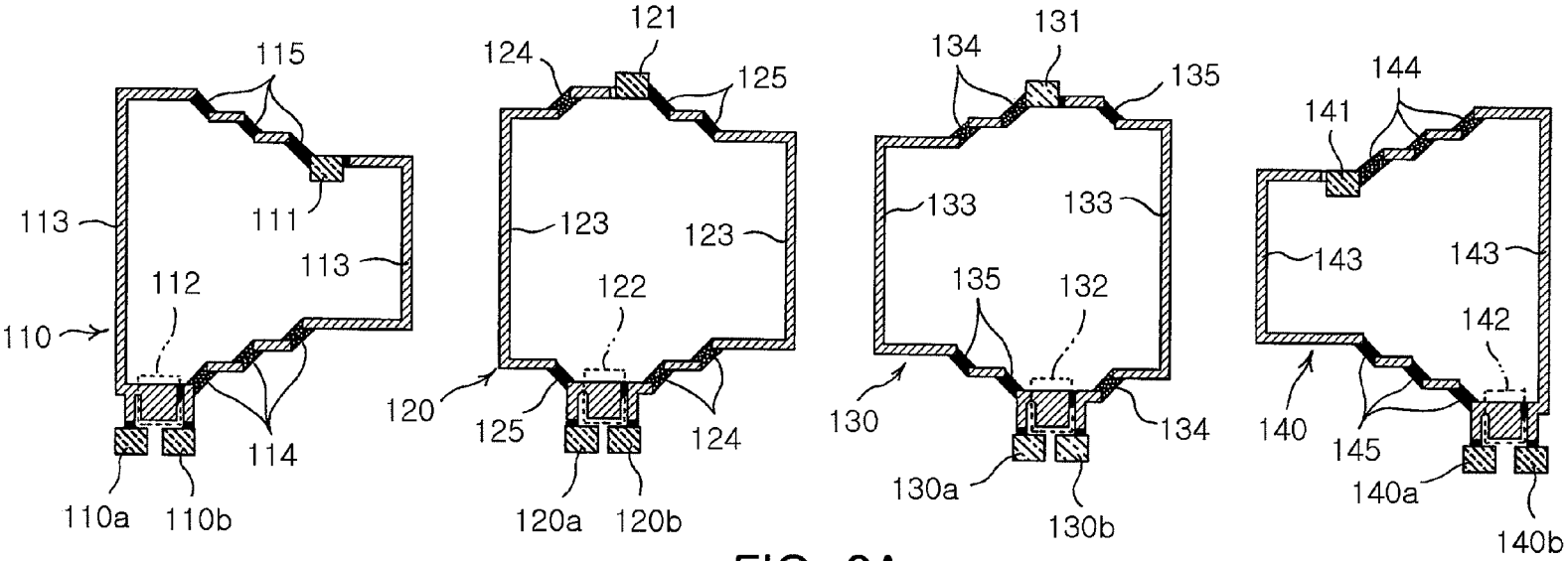
FIGS. 2A and 2B are diagrams illustrating an input conductive line structure and an output conductive line structure forming the transformer of FIG. 1, respectively.
Figure 2B:
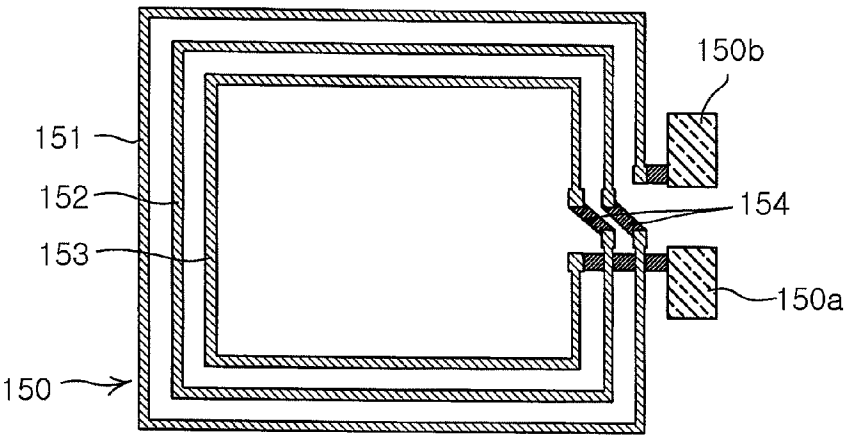

FIG. 2A is a diagram illustrating a structure of the input conductive lines 110, 120, 130, and 140 of the transformer 100, and FIG. 2B is a diagram illustrating a structure of the output conductive line 150 of the transformer 100.

FIG. 2A illustrates the four input conductive lines 110, 120, 130, and 140.

Not to directly connect one another, a part of the each of the input conductive lines 110, 120, 130, and 140 maybe formed on the top of the multilayer board 101 and other parts may be formed on other layers different from the top surface of the multilayer board 101.

The first conductive line 110 may include a first area 113 formed on the top surface of the multilayer board 101, a second area 114 formed on a second layer of the multilayer board 101, and a third area 115 formed on a third layer of the multilayer board 101. The first area 113, the second area 114, and the third area 115 may be connected to one another via a via hole.

In the present embodiment, a portion of the first area 113 formed on the top surface of the multilayer board 101 may be provided to the power supply pad 111. The power supply pad 111 may be connected to the first conductive line 110 formed on another layer via a via hole.

The second line 120, the third line 130, and the fourth line 140 may include first areas 123, 133, and 143 formed on the surface of the multilayer board 101, second areas 124, 134, and 144 formed on the second layer of the multilayer board 101, and third areas 125, 135, and 145 formed on the third layer of the multilayer board 101, which may be connected to one another via a via hole. Also, a part of each of the first areas 123, 133, and 143 formed on the top surface of the multilayer board 101 may be provided to the power supply pads 121, 131, and 141.

On both ends of the each of the input conductive lines 110, 120, 130, and 140, the capacitors 112, 122, 132, and 142 may be formed. The capacitors 112, 122, 132, and 142 may be embodied by conductive layers formed on the top surface of the multilayer board 101 and other layers of the multilayer board 101.

FIG. 2B illustrates the output conductive line 150.

The output conductive line 150 may include a first loop 151, a second loop 152, and a third loop 153. Each of the loops 151, 152, and 153 may be connected to partial conductive lines 154 formed on the top surface and another layer of the multilayer board 101 via a via hole to form the output conductive line 150.

The first loop 151 may be formed between the first conductive line 110 and the second conductive line 120. The second loop 152 may be formed between the second conductive line 120 and the third conductive line 130. The third loop 153 may be formed between the third conductive line 130 and the fourth conductive line 140.

Figure 3A:
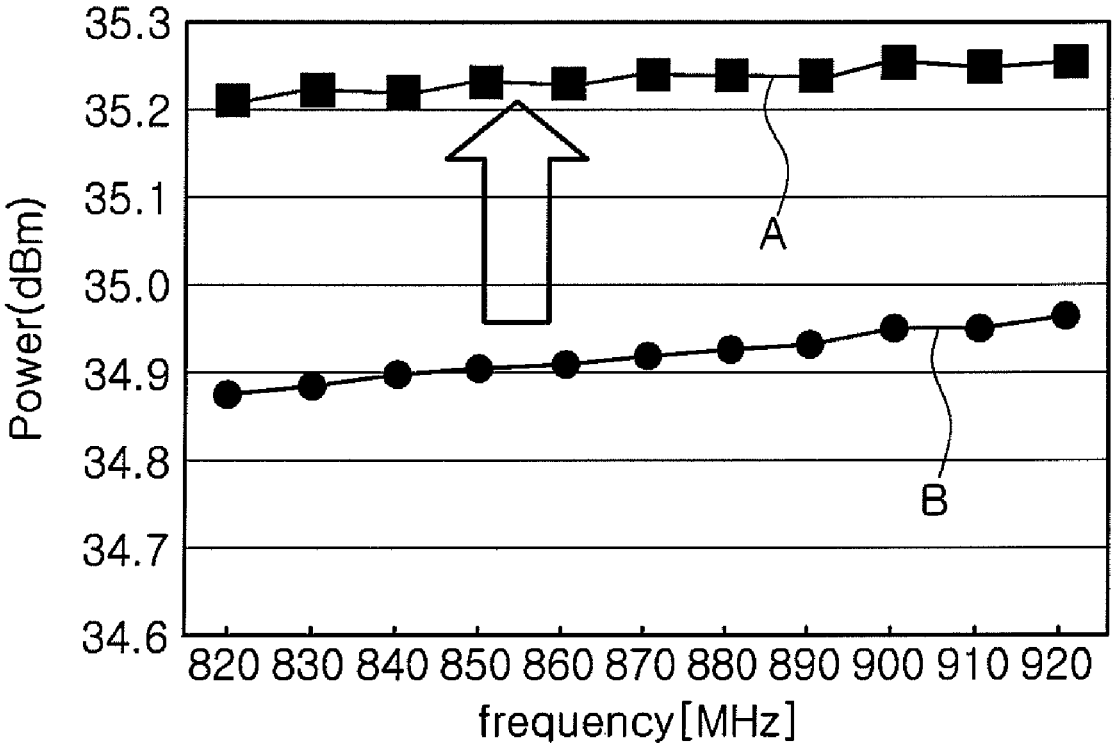
FIGS. 3A to 3C are graphs where the transformer of FIG. 1 and a conventional transformer are compared with each other in aspects of output power, output efficiency, and harmonics components.
Figure 3B:
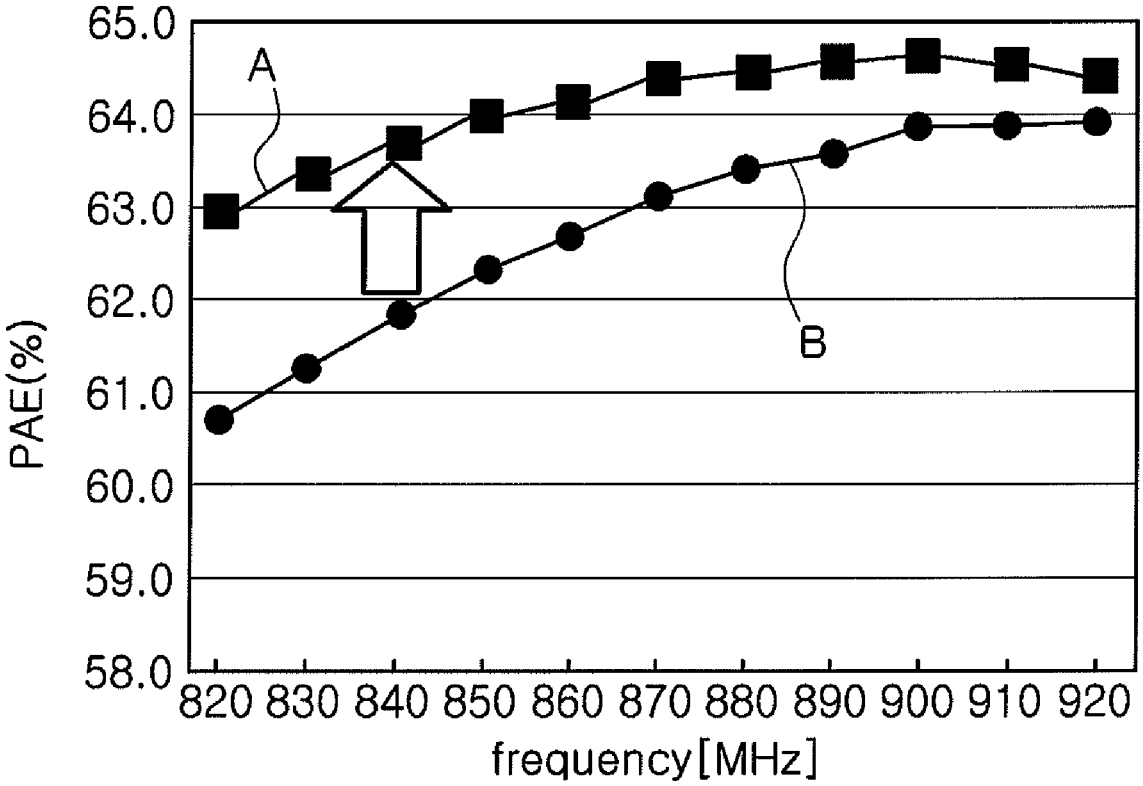
Figure 3C:
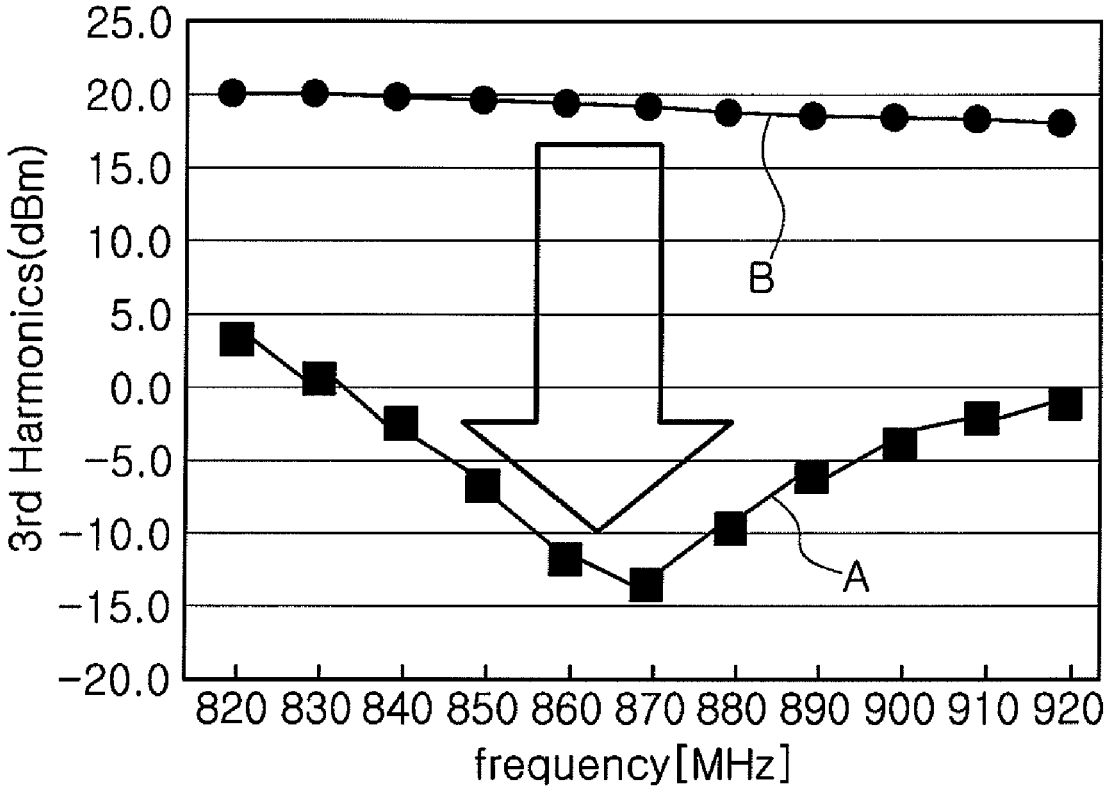

FIGS. 3A to 3C are graphs where the transformer 100 and a conventional transformer are compared with each other in aspects of output power, output efficiency, and harmonics components. In the present embodiment, the conventional transformer does not include a harmonics remover and a power supply pad. In the present embodiment, an output at a frequency in global system for mobile communication (GSM) band from 820 to 920 MHz is measured.

Referring to FIG. 3A, an output B of the conventional transformer is shown as 35 dBm or less. On the other hand, an output A of the transformer 100 is shown as 35.2 dBm or more. It may be known that a size of the output A is greater than that of the output B.

Referring to FIG. 3B, at the frequency of in the GSM band, efficiency B of an output signal to an input signal of the conventional transformer is shown as about 61 to 64% and efficiency A of an output signal to an input signal of the transformer 100 is shown as about 63 to 65%.

Referring to FIG. 3C, a third harmonics component A in the output signal of the transformer 100 is greatly reduced that a third harmonics component B in the output signal of the conventional transformer, which is an effect due to the harmonics remover 160 of the transformer 100.

Particularly, in the case of the conventional transformer, the third harmonics component does not greatly vary with a frequency change. However, in the case of the transformer 100, the third harmonics component is more greatly decreased at a particular frequency band, which is possible by controlling the inductor element of the harmonics remover160. A location of the wire bonding may be controlled to control the inductor element.

Figure 4:
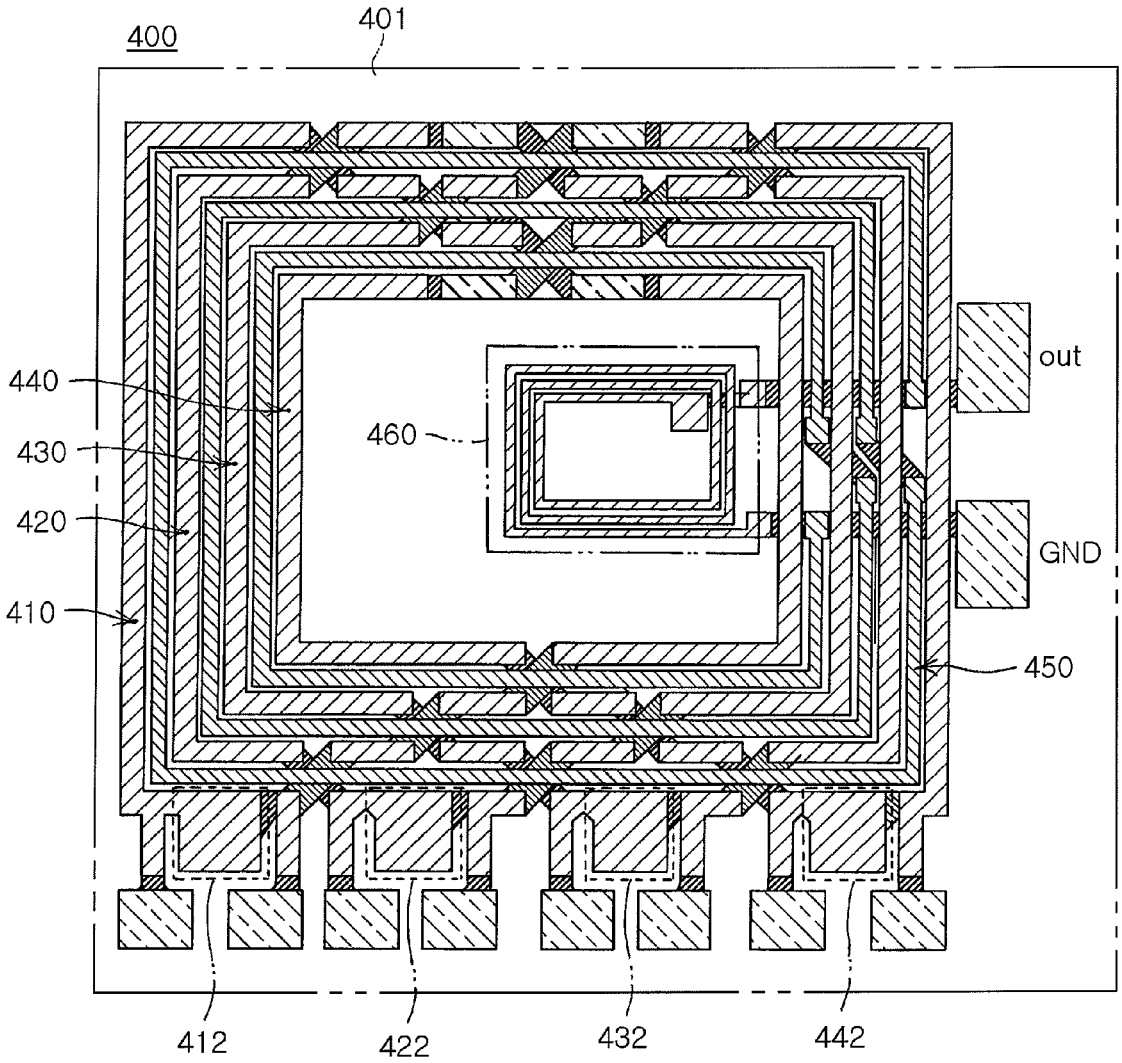
FIG. 4 is a diagram illustrating a structure of a transformer according to another embodiment of the present invention.

FIG. 4 is a configuration diagram illustrating a transformer 400 according to another embodiment of the present invention.

Referring to FIG. 4, the transformer 400 may include a multilayer board 401, a plurality of input conductive lines 410, 420, 430, and 440 formed on the multilayer board 401, one output conductive line 450, and a harmonics remover 460.

The multilayer board 401 may include a plurality of layers.

In the present embodiment, the input conductive lines 410, 420, 430, and 440 and the output conductive line 450 may be formed on a top surface and other layers of the multilayer board 401 not to be directly connected to one another, which may be connected via a via hole. The multilayer board 401 may be formed of a high frequency board.

Each of the input conductive lines 410, 420, 430, and 440 may have both ends provided to a positive input terminal and a negative input terminal, respectively. The both ends may be connected to a power amplifier connected to the transformer 400, respectively. The transformer 400 may be connected to the power amplifier formed of a complementary metal-oxide semiconductor used in a mobile communication terminal.

In the present embodiment, the four input conductive lines 410, 420, 430, and 440 may be formed to not to be connected to one another on the multilayer board 401. For this, a part of the respective input conductive lines 410, 420, 430, and 440 may be formed on the top surface of the multilayer board 401 and others may be formed on other layers different from the top surface of the multilayer board 401 to have a structure of being connected via the via hole. A detailed structure of the input conductive lines 410, 420, 430, and 440 formed on the multilayer board 401 is similar to the structure shown in FIG. 2A.

The four input conductive lines 410, 420, 430, and 440 may form a loop around the same area of the multilayer board 401, respectively.

Between the both ends of the each of the input conductive lines 410, 420, 430, and 440, capacitors 412, 422, 432, and 442 may be formed. The capacitors 412, 422, 432, and 442 may be embodied by forming conductive layers having a predetermined area on different layers of the multilayer board 401.

To form an electromagnetic coupling with the each of the input conductive lines 410, 420, 430, and 440, the output conductive line 450 may be formed adjacent to the input conductive lines 410, 420, 430, and 440. One end of the output conductive line 450 may be provided to an output terminal and another end thereof may be connected to a ground.

In the present embodiment, since the four input conductive lines 410, 420, 430, and 440 form the loop around the same area on the multilayer board 401, the output conductive line 450 may also form a loop around the same area on the multilayer board 401. Also, the loop may be formed between each of the respective input conductive lines 410, 420, 430, and 440 to form the electromagnetic coupling with the each of the input conductive lines 410, 420, 430, and 440.

The output conductive line 450 may have a structure in which a portion is formed on the top surface of the multilayer board 401 and another portion is formed on the another layer different from the top surface of the multilayer board 401, which are connected to one another via a via hole, not to directly connected to the respective input conductive lines 410, 420, 430, and 440.

On the both ends of the output conductive line 450, the harmonics remover 460 may be formed.

Since an output signal of the transformer may be outputted including harmonics components, the harmonics remover 460 may be formed to remove the harmonics components.

In the present embodiment, the harmonics remover 460 may be formed in a center of the loops formed by the four input conductive lines 410, 420, 430, and 440 on the multilayer board 401.

The harmonics remover 460 may be formed in such a way that an inductor element and a capacitor element may be serially connected to each other. The inductor element may be connected via an external wire bonding, and harmonics in a desired band may be tuned by controlling a location of the wire bonding.

The harmonics components of the output signal outputted to the output terminal of the transformer may be removed by the inductor element and the capacitor element.

Figure 5:
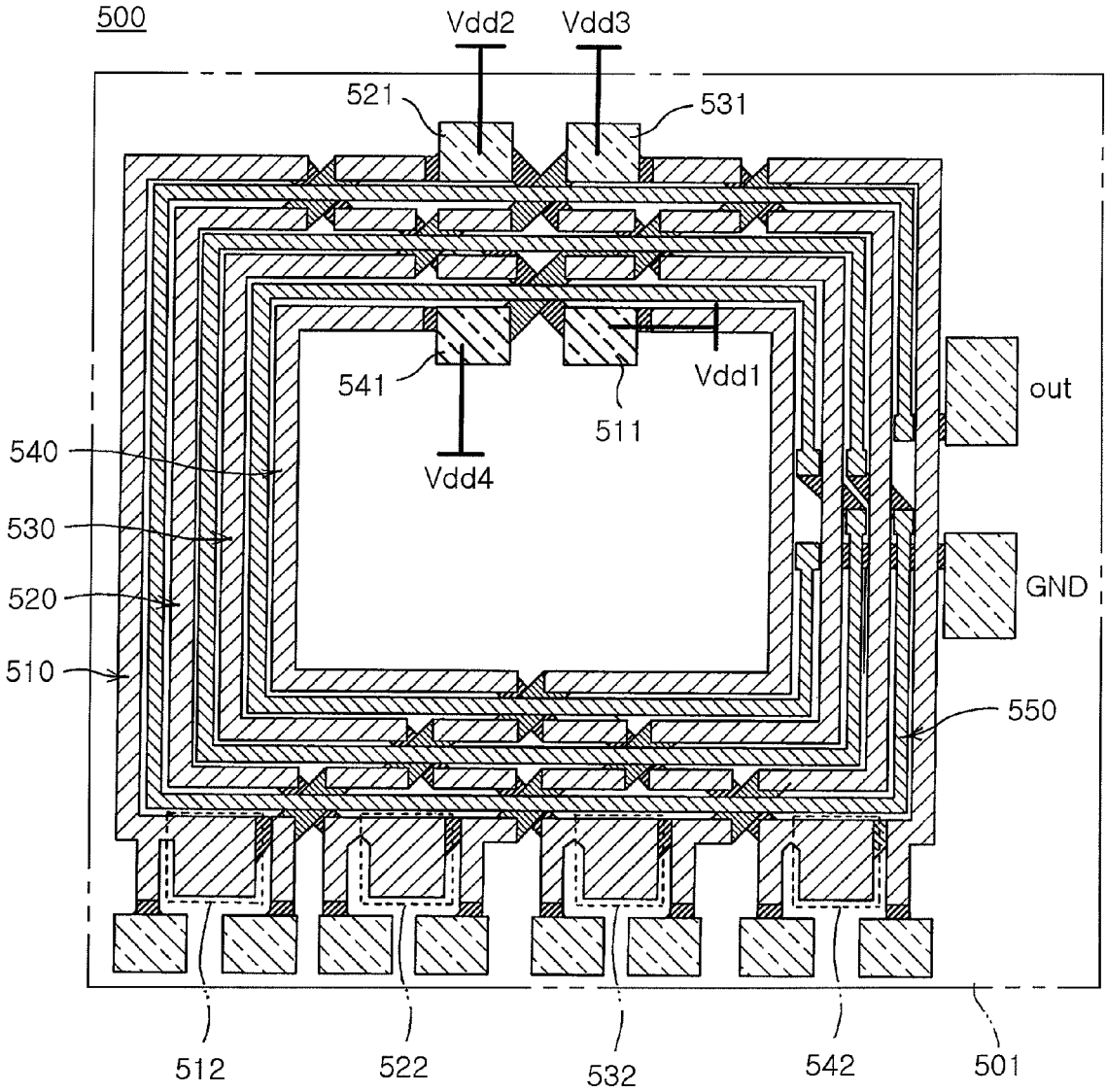
FIG. 5 is a diagram illustrating a structure of a transformer according to still another embodiment of the present invention.

FIG. 5 is a configuration diagram illustrating a transformer 500 according to still another embodiment of the present invention.

Referring to FIG. 5, the transformer 500 may include a multilayer board 501, a plurality of input conductive lines 510, 520, 530, and 540 formed on the multilayer board 501, one output conductive line 550, and power supply pads 511, 521, 531, and 541 forming a portion of each of the plurality of input conductive lines 510, 520, 530, and 540.

The multilayer board 501 may include a plurality of layers.

In the present embodiment, the input conductive lines 510, 520, 530, and 540 and the output conductive line 550 may be formed on a top surface and other layers of the multilayer board 501, which may be connected via a via hole. The multilayer board 501 may be formed of a high frequency board.

Each of the input conductive lines 510, 520, 530, and 540 may have both ends provided to a positive input terminal and a negative input terminal, respectively. The both ends may be connected to a power amplifier connected to the transformer 500, respectively. The transformer 500 may be connected to the power amplifier formed of a complementary metal-oxide semiconductor used in a mobile communication terminal.

In the present embodiment, the four input conductive lines 510, 520, 530, and 540 may be formed to not to be connected to one another on the multilayer board 501. For this, a part of the respective input conductive lines 510, 520, 530, and 540 may be formed on the top surface of the multilayer board 501 and others may be formed on other layers different from the top surface of the multilayer board 501 to have a structure of being connected via the via hole. A detailed structure of the input conductive lines 510, 520, 530, and 540 formed on the multilayer board 501 will be described later with reference to FIG. 2A.

The four input conductive lines 510, 520, 530, and 540 may form a loop around the same area of the multilayer board 501, respectively.

Between the both ends of the each of the input conductive lines 510, 520, 530, and 540, capacitors 512, 522, 532, and 542 may be formed. The capacitors 512, 522, 532, and 542 may be embodied by forming conductive layers having a predetermined area on different layers of the multilayer board 501.

To form an electromagnetic coupling with the each of the input conductive lines 510, 520, 530, and 540, the output conductive line 550 may be formed adjacent to the input conductive lines 510, 520, 530, and 540. One end of the output conductive line 550 may be provided to an output terminal and another end thereof may be connected to a ground.

In the present embodiment, since the four input conductive lines 510, 520, 530, and 540 form the loop around the same area on the multilayer board 501, the output conductive line 550 may also form a loop around the same area on the multilayer board 501. Also, the loop may be formed between each of the respective input conductive lines 510, 520, 530, and 540 to form the electromagnetic coupling with the each of the input conductive lines 510, 520, 530, and 540.

The output conductive line 550 may have a structure in which a portion is formed on the top surface of the multilayer board 501 and another portion is formed on the another layer different from the top surface of the multilayer board 501, which are connected to one another via a via hole, not to directly connected to the respective input conductive lines 510, 520, 530, and 540.

The power supply pads 511, 521, 531, and 541 may be formed in one area of the respective input conductive lines 510, 520, 530, and 540.

The power supply pads 511, 521, 531, and 541 may be provided as terminals for supplying power to the respective input conductive lines 510, 520, 530, and 540, respectively. The power supply pads 511, 521, 531, and 541 may be located where an electrical radio frequency (RF) swing electric potential is 0 V in the respective input conductive lines 510, 520, 530, and 540. Since there is no direct current (DC) ground in a CMOS power amplifier, the CMOS power amplifier employs an alternative current (AC) ground. A location where the RF swing electric potential is 0 V indicates the AC ground.

The power supply pads 511, 521, 531, and 541 may be formed in such a way that a coupling value with the output conductive line 550 adjacent to the four input conductive lines 51, 520, 530, and 540 is uniform. Since the power supply pads 511, 521, 531, and 541 may have a greater width than a width of the input conductive lines 510, 520, 530, and 540, a distance to the output conductive line 550 may be different according to a location of each of the power supply pads 511, 521, 531, 541. In the present embodiment, the power supply pads 511, 521, 531, and 541 may be located in an outermost area (121 and 531) and in an innermost area (111 and 541) of the input conductive lines 510, 520, 530, and 540 forming the loop, respectively, in such a way that a distance between the power supply pads 511, 521, 531, and 541 and the output conductive line 550 is identical to a distance between the input conductive lines 510, 520, 530, and 540 and the output conductive line 550.

Also, the power supply pads 511, 521, 531, and 541 may be formed in such a way that distances between the respective power supply pads 511, 521, 531, and 541 and the output conductive line 550 and distances between the input conductive lines 510, 520, 530, and 540 where the power supply pads 511, 521, 531, and 541 are formed, respectively, and the output conductive line 550 are definite.

Directly forming the power supply pads 511, 521, 531, and 541 on the input conductive lines 510, 520, 530, and 540, there is no need to form additional conductive lines to form the power supply pads 511, 521, 531, and 541. Accordingly, an undesired coupling that may be caused by another conductive line.

While the present invention has been shown and described in connection with the exemplary embodiments, it will be apparent to those skilled in the art that modifications and variations can be made without departing from the spirit and scope of the invention as defined by the appended claims.

What is claimed is:

1. A transformer, comprising:

a multilayer board;

at least one input conductive line formed on the multilayer board, defining a loop that extends around an inner area, and having two ends connected to input terminals of a positive signal and a negative signal, respectively;

an output conductive line formed adjacent to the at least one input conductive line to form an electromagnetic coupling with the at least one input conductive line, said output conductive line having one end connected to an output terminal and another end connected to a ground;

a power supply pad directly formed on the at least one input conductive line; and a harmonics remover formed between the one end and the another end of the output conductive line to remove harmonics components of a signal outputted from the output conductive line, said harmonics remover being formed in the inner area surrounded by the loop defined by the at least one input conductive line; wherein each of the at least one input conductive line and the output conductive line comprises different parts which are formed on different layers of the multilayer board, respectively, and which are connected to each other via a via hole; and the output conductive line is free of direct electrical connection to the at least one input conductive line.

2. The transformer of claim 1, wherein the harmonics remover comprises an inductor and a capacitor serially connected to each other.

3. The transformer of claim 1, wherein the at least one input conductive line comprises a capacitor element formed between the two ends thereof.

4. The transformer of claim 1, wherein the at least one input conductive line comprises a first conductive wire, a second conductive wire, a third conductive wire, and a fourth conductive wire, each of said first through fourth conductive wires forming one loop around the same inner area on the multilayer board, respectively.

5. The transformer of claim 4, wherein the power supply pads directly formed on the first to fourth conductive wires, respectively, are formed on a top surface of the multilayer board.

6. The transformer of claim 4, wherein the output conductive line comprises:

a first loop formed between the first conductive wire and the second conductive wire;

a second loop formed between the second conductive wire and the third conductive wire; and a third loop formed between the third conductive wire and the fourth conductive wire.

7. The transformer of claim 1, wherein the power supply pad has a width greater than that of the at least one input conductive line on which said power supply pad is directly formed.

8. The transformer of claim 1, wherein the power supply pad is directly formed on the at least one input conductive line in a location where an electrical radio frequency (RF) swing electric potential is 0 V in the at least one input conductive line.

9. The transformer of claim 7, wherein the power supply pad is formed in such a way that a distance between the power supply pad and the output conductive line is identical to a distance between (i) the at least one input conductive line where the power supply pad is not formed and (ii) the output conductive line.

10. A transformer, comprising:

a multilayer board;

at least one input conductive line formed on the multilayer board, defining a loop that extends around an inner area, and having two ends connected to input terminals of a positive signal and a negative signal, respectively;

an output conductive line formed adjacent to the at least one input conductive line to form an electromagnetic coupling with the at least one input conductive line, said output conductive line having one end connected to an output terminal and another end connected to a ground; and a harmonics remover formed between the one end and the another end of the output conductive line to remove harmonics components in a signal outputted from the output conductive line, said harmonics remover being formed in the inner area surrounded by the loop defined by the at least one input conductive line;

wherein each of the at least one input conductive line and the output conductive line comprises different parts which are formed on different layers of the multilayer board, respectively, and which are connected to each other via a via hole; and the output conductive line is free of direct electrical connection to the at least one input conductive line.

11. The transformer of claim 10, wherein the harmonics remover comprises an inductor and a capacitor serially connected to each other.

12. The transformer of claim 10, wherein the at least one input conductive line comprises a capacitor element formed between the two ends thereof.

13. The transformer of claim 10, wherein the at least one input conductive line comprises a first conductive wire, a second conductive wire, a third conductive wire, and a fourth conductive wire, each of said first through fourth conductive wires forming one loop around the same inner area on the multilayer board, respectively.

14. The transformer of claim 13, wherein the output conductive line comprises:

a first loop formed between the first conductive wire and the second conductive wire;

a second loop formed between the second conductive wire and the third conductive wire; and a third loop formed between the third conductive wire and the fourth conductive wire.

* * * * *